US009416969B2

(12) United States Patent
Weaver et al.

(10) Patent No.: US 9,416,969 B2
(45) Date of Patent: Aug. 16, 2016

(54) GAS TURBINE TRANSITION INLET RING ADAPTER

(71) Applicants: Adam J. Weaver, Tega Cay, SC (US); Lashanda N. Oliver, Charlotte, NC (US); Daniel W. Garan, Chuluota, FL (US); Ashtad Kotwal, Oviedo, FL (US)

(72) Inventors: Adam J. Weaver, Tega Cay, SC (US); Lashanda N. Oliver, Charlotte, NC (US); Daniel W. Garan, Chuluota, FL (US); Ashtad Kotwal, Oviedo, FL (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 341 days.

(21) Appl. No.: 13/803,463

(22) Filed: Mar. 14, 2013

(65) Prior Publication Data

US 2014/0260316 A1 Sep. 18, 2014

(51) Int. Cl.

| | |
|---|---|
| ***F23R 3/00*** | (2006.01) |
| ***F01D 9/02*** | (2006.01) |
| ***F23R 3/60*** | (2006.01) |
| ***F01D 9/04*** | (2006.01) |

(52) U.S. Cl.

CPC . *F23R 3/00* (2013.01); *F01D 9/023* (2013.01); *F01D 9/04* (2013.01); *F23R 3/002* (2013.01); *F23R 3/60* (2013.01); *F23R 2900/00012* (2013.01)

(58) Field of Classification Search

CPC .. F23R 3/60; F23R 2900/00012; F23R 3/002; F01D 9/023

USPC ..... 60/39.37, 796

See application file for complete search history.

(56) References Cited

U.S. PATENT DOCUMENTS

| | | | | |
|---|---|---|---|---|
| 2,494,659 | A * | 1/1950 | Huyton | 285/41 |
| 2,615,300 | A * | 10/1952 | Lombard | 60/800 |
| 3,759,038 | A | 9/1973 | Scalzo et al. | |
| 4,016,718 | A | 4/1977 | Lauck | |
| 4,413,470 | A | 11/1983 | Scheihing et al. | |
| 5,309,710 | A | 5/1994 | Corr, II | |
| 5,474,306 | A | 12/1995 | Bagepalli et al. | |
| 5,557,920 | A | 9/1996 | Kain | |
| 5,987,879 | A | 11/1999 | Ono | |
| 6,571,560 | B2 | 6/2003 | Tatsumi et al. | |
| 6,732,528 | B2 | 5/2004 | Akagi et al. | |
| 6,869,082 | B2 | 3/2005 | Parker | |
| 7,093,837 | B2 | 8/2006 | Parker et al. | |
| 7,178,340 | B2 * | 2/2007 | Jorgensen | 60/800 |
| 7,377,116 | B2 | 5/2008 | Parker et al. | |
| 7,555,906 | B2 | 7/2009 | Anichini et al. | |
| 7,647,779 | B2 | 1/2010 | Shi et al. | |
| 7,685,823 | B2 | 3/2010 | Martling et al. | |

(Continued)

FOREIGN PATENT DOCUMENTS

JP S58102031 A 6/1983

*Primary Examiner* — William H Rodriguez
*Assistant Examiner* — Eric Linderman

(57) ABSTRACT

A combustion system for a gas turbine engine including a combustor assembly comprising a combustor basket having a downstream terminal end, and a transition duct extending downstream from the combustor basket and having an upstream end located adjacent to the downstream terminal end of the combustor basket. A coupling is provided comprising an inlet ring adapter including a cylindrical sleeve extending downstream of the upstream end of the transition duct in overlapping relation to an inner surface of the transition duct. A spring clip assembly is mounted to the terminal end of the combustor basket. The spring clip assembly extends into engagement with and forms a seal on the cylindrical sleeve.

16 Claims, 5 Drawing Sheets

(56) References Cited

U.S. PATENT DOCUMENTS

| | | | | |
|---|---|---|---|---|
| 8,650,852 | B2 * | 2/2014 | Lebegue et al. | 60/39.37 |
| 8,991,192 | B2 * | 3/2015 | Wiebe et al. | 60/800 |
| 2001/0032453 | A1 * | 10/2001 | Tatsumi | F23R 3/60 60/796 |
| 2004/0031270 | A1 * | 2/2004 | Sileo et al. | 60/796 |
| 2005/0050902 | A1 * | 3/2005 | Anichini et al. | 60/800 |
| 2005/0132708 | A1 * | 6/2005 | Martling et al. | 60/752 |
| 2006/0242964 | A1 | 11/2006 | Parker et al. | |
| 2007/0012043 | A1 * | 1/2007 | Parker | F23R 3/60 60/752 |
| 2007/0258808 | A1 * | 11/2007 | Ohri | F01D 9/023 415/139 |
| 2008/0041058 | A1 * | 2/2008 | Johnson et al. | 60/725 |
| 2008/0179837 | A1 * | 7/2008 | Ryan | 277/591 |
| 2009/0145137 | A1 * | 6/2009 | Rizkalla et al. | 60/796 |
| 2010/0050649 | A1 * | 3/2010 | Allen | 60/752 |
| 2010/0064693 | A1 | 3/2010 | Koenig et al. | |
| 2010/0071376 | A1 * | 3/2010 | Wiebe | F23R 3/002 60/740 |
| 2011/0067402 | A1 * | 3/2011 | Wiebe | F23R 3/08 60/740 |
| 2012/0047910 | A1 * | 3/2012 | Sutcu | F01D 9/023 60/796 |
| 2012/0291437 | A1 * | 11/2012 | Moehrle et al. | 60/722 |

* cited by examiner

GAS TURBINE TRANSITION INLET RING ADAPTER

FIELD OF THE INVENTION

The present invention relates to a combustor device and transition duct assembly in a gas turbine engine and, more particularly, to such an assembly having a transition duct comprising an inlet ring adapter for cooperating with a spring clip seal on the combustor device.

BACKGROUND OF THE INVENTION

A modern gas turbine engine, such as is used for generation of electricity at power plants, is a multi-part assembly of sub-components, many of which are subjected to vibrational and thermal stresses over long periods of operation. To the extent that various sub-components and their respective parts are designed, manufactured, shipped and installed to reduce undesired stresses, this may result in longer operation and less downtime.

In common configurations of gas turbine engines, a plurality of combustors is arranged circumferentially about a longitudinal axis of the engine. Compressed air from a compressor is mixed with fuel in each combustor and flows to a combustion zone where the fuel/air mixture is ignited to form a hot working gas. The combustion zone begins downstream from a base plate within the combustor that demarcates an upstream end of the combustion zone. The combustion zone may terminate before or may extend into what is referred to as a transition duct. The transition duct is a conduit that carries hot gases into a turbine section of the engine where the hot working gases pass through a series of alternating rows of turbine vanes and turbine blades to extract work.

A common approach to assembly of a transition duct with a combustor in a gas turbine engine is to attach an assembly of spring clips at a downstream end of the combustor. For example, a spring clip ring assembly may be provided at a downstream end of a combustor that provides sliding support that accommodates thermal growth of the combustor and transition duct. Spring clip ring assemblies may comprise a plurality of spring fingers that are resiliently biased radially outwardly from the end of the combustor into engagement with an inner surface of an inlet ring located at an upstream end of the transition duct. A known spring clip seal assembly incorporated in a gas turbine engine is disclosed in U.S. Pat. No. 7,093,837, which patent is incorporated herein in its entirety.

SUMMARY OF THE INVENTION

In accordance with an aspect of the invention, a combustion system is provided for a gas turbine engine. The combustion system comprises a combustor assembly comprising a combustor basket having a downstream terminal end, and a transition duct extending downstream from the combustor basket and having an upstream end located adjacent to the downstream terminal end of the combustor basket. An inlet ring adapter is affixed to the upstream end of the transition duct. The inlet ring adapter extends downstream of the upstream end of the transition duct in overlapping relation to an inner surface of the transition duct. A spring clip assembly is mounted to the terminal end of the combustor basket and is resiliently biased into engagement with an inwardly facing surface of the inlet ring adapter to form a coupling between the combustor basket and the transition duct.

The inlet ring adapter may comprise a cylindrical sleeve extending generally parallel to the transition duct, and a flange portion extending perpendicular to the sleeve and attached to the upstream end of the transition duct.

The flange portion may be formed with apertures for receiving removable fasteners, and the upstream end of the transition duct may include threaded holes for receiving bolts received through the apertures in the flange portion.

A bolt ring may be affixed to the upstream end of the transition duct and may include the threaded holes. The bolt ring may define a radial thickness that is greater than a radial thickness of the upstream end of the transition duct. The bolt ring may be welded to the upstream end of the transition duct. Alternatively, the bolt ring may be formed integral with the upstream end of the transition duct.

The transition duct may include a radial step at the upstream end to define a first larger diameter adjacent to the sleeve of the inlet ring adapter and a second smaller diameter extending in a direction distal from the inlet ring adapter.

The inwardly facing surface of the inlet ring adapter may define an inner diameter that is greater than the second smaller diameter of the transition duct.

The sleeve of the inlet ring adapter may include a distal downstream end that is located adjacent to the radial step of the transition duct that may effect a reduction in recirculation flow at the radial step.

In accordance with another aspect of the invention, a combustion system is provided for a gas turbine engine. The combustion system comprises a combustor assembly comprising a combustor basket having a downstream terminal end, and a transition duct extending downstream from the combustor basket and having an upstream end located adjacent to the downstream terminal end of the combustor basket. A coupling is provided comprising an inlet ring adapter including a cylindrical sleeve extending downstream of the upstream end of the transition duct in overlapping relation to an inner surface of the transition duct. A spring clip assembly is mounted to the terminal end of the combustor basket. The spring clip assembly extends into engagement with and forms a seal on the cylindrical sleeve.

The cylindrical sleeve may be spaced radially inwardly from the inner surface of the transition duct.

The cylindrical sleeve may be mounted on the transition duct with removable fasteners. A flange portion may extend radially outwardly from the cylindrical sleeve, and apertures may be formed through the flange portion for receiving the removable fasteners.

A bolt ring may be welded to the upstream end of the transition duct, and may include threaded holes for receiving the removable fasteners.

At least a portion of the spring clip assembly may be resiliently biased into engagement with an inwardly facing surface of the cylindrical sleeve.

The transition duct may include a radial step at the upstream end to define a first larger diameter adjacent to the cylindrical sleeve and a second smaller diameter extending in a direction distal from the cylindrical sleeve.

An inwardly facing surface of the cylindrical sleeve may define an inner diameter that is greater than the second smaller diameter of the transition duct.

The cylindrical sleeve may include a distal downstream end that is located adjacent to the radial step of the transition duct that may effect a reduction in recirculation flow at the radial step.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
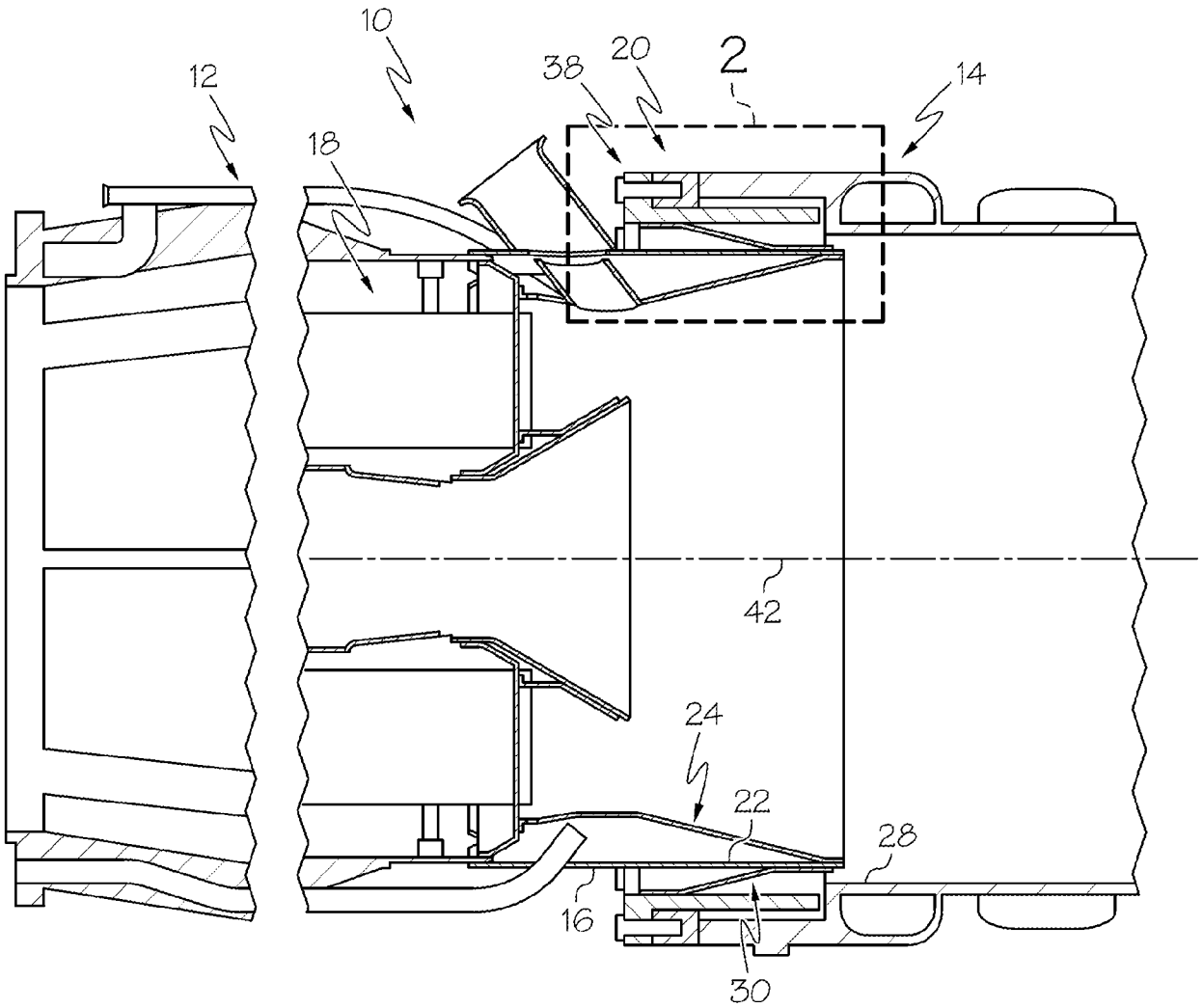
FIG. 1 is a cross-sectional view of a combustor assembly incorporating an inlet ring adapter in accordance with aspects of the present invention.

Referring to FIG. 1, a portion of a can-annular combustion system of a gas turbine engine is shown and includes a combustor assembly 10 comprising a combustor basket 12 and a transition duct 14. The combustor basket 12 comprises a cylindrical liner 16 and a burner assembly 18 located at an upstream end of the liner 16. The combustor basket 12 is configured to be supported in a combustor casing (not shown) in a known manner to receive air and fuel which are combusted downstream of the burner assembly 18 to form a hot working gas passing through the liner 16.

Figure 3:
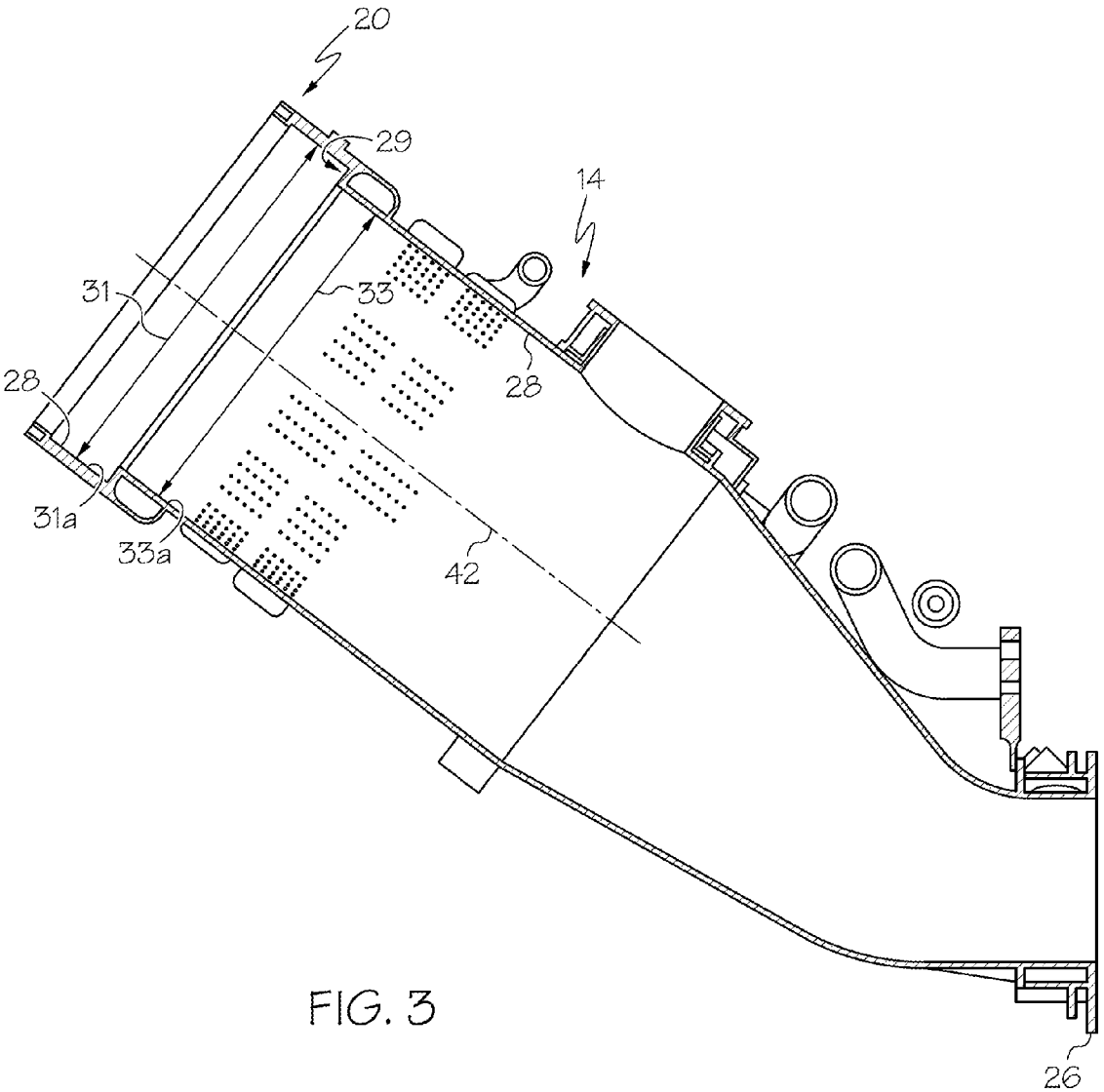
FIG. 3 is a cross-sectional view of a transition duct for the combustor assembly of FIG. 1.

The transition duct 14 includes an upstream end 20, defining a transition inlet ring, that is adjacent and coupled to a terminal downstream end 22 of the combustor basket 12 at a circumferentially extending coupling 24 between the liner 16 and the transition duct 14. The upstream end 20 of the transition duct 14 receives the hot working gases from the downstream end 22 of the combustor basket 12, and the transition duct 14 defines a gas path to a downstream end 26 (FIG. 3) at an inlet to a turbine section of the engine. The downstream end 22 of the combustor basket 12, as defined by the liner 16, extends in overlapping relation to an inner surface 28 of the transition duct 14, and the coupling 24 forms a seal for preventing or limiting leakage of combustor shell air at the interface between the combustor basket 12 and the transition duct 14.

Figure 2:
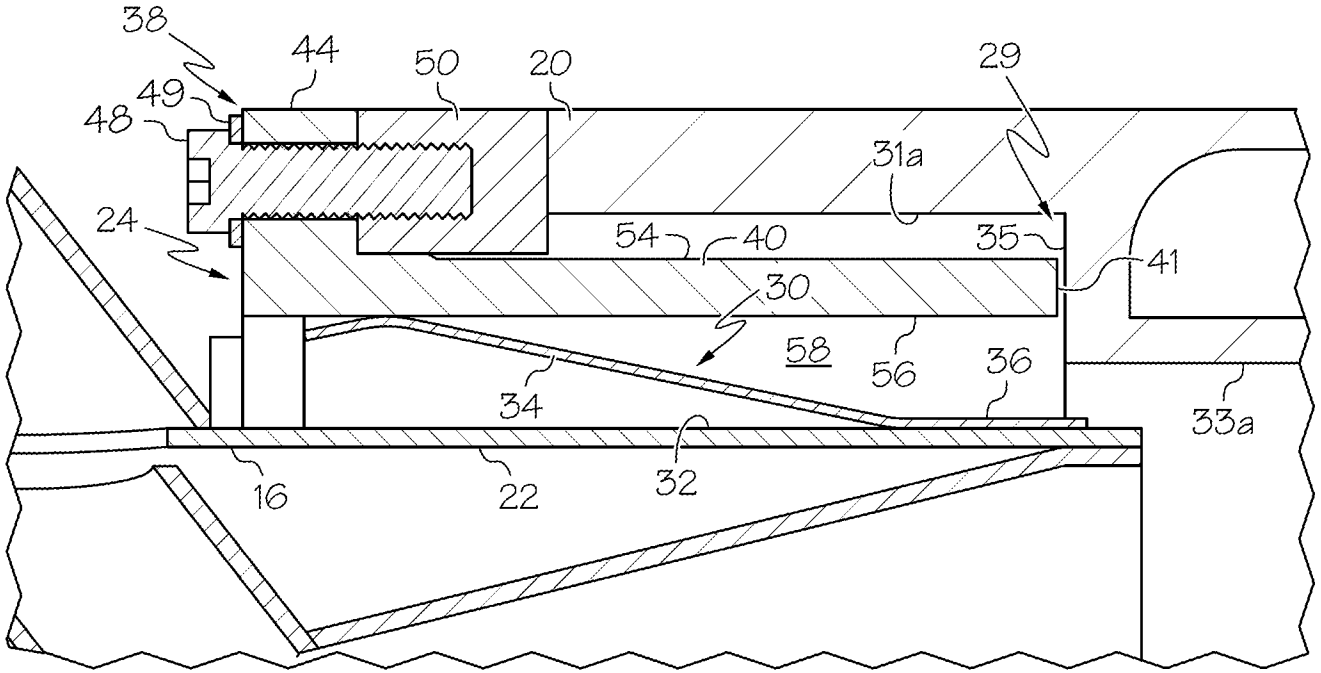
FIG. 2 is an enlarged view of an area 2 identified in FIG. 1.
Figure 7:
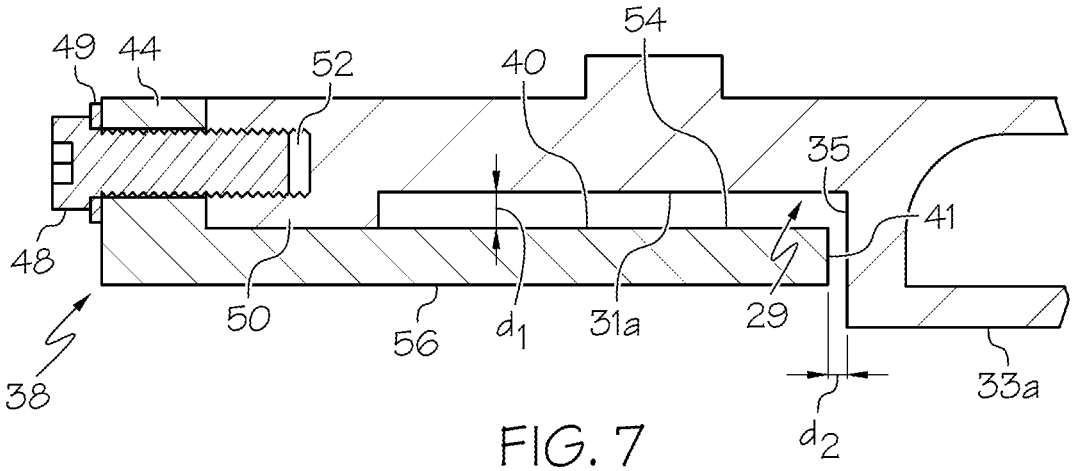
FIG. 7 is an enlarged cross-sectional view of the inlet ring adapter assembled to the inlet end of the transition duct.

As best seen in FIGS. 2 and 7, at the location of the coupling 24, the inner surface 28 of the transition duct 14 is formed with a stepped area 29. The stepped area is formed by an upstream first larger diameter 31 (FIG. 3) defined by a first inner surface 31*a*, and a downstream second smaller diameter 33 (FIG. 3) defined by a second inner surface 33*a* extending in an axial direction distal from the first inner surface 31*a*. The first and second inner surfaces 31*a*, 33*a* are connected by a radial step wall 35.

In accordance with an aspect of the invention, the coupling 24 comprises structure on the transition duct 14 for cooperating with a conventional spring clip assembly or seal 30 mounted to a radially outer surface 32 of the liner 16, as seen in FIG. 2. The spring clip seal 30 may comprise a structure having a plurality of spring clip leaves or fingers 34 resiliently biased outwardly, such as is described in U.S. Pat. No. 7,093,837. The spring clip seal 30 includes a radially inner section 36 that may be attached to the outer surface 32 of the liner 16 by a weld or similar connection. It should be understood that although specific reference is made to the spring clip seal of U.S. Pat. No. 7,093,837 for exemplary purposes, the present invention is not limited to assemblies specific to the spring clip seal disclosed in the referenced patent.

Figure 5:
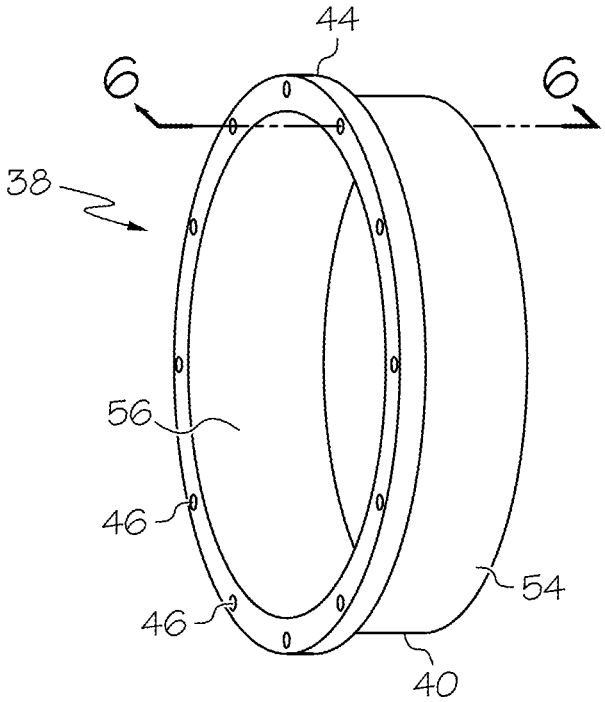
FIG. 5 is a perspective view of the inlet ring adapter.
Figure 6:
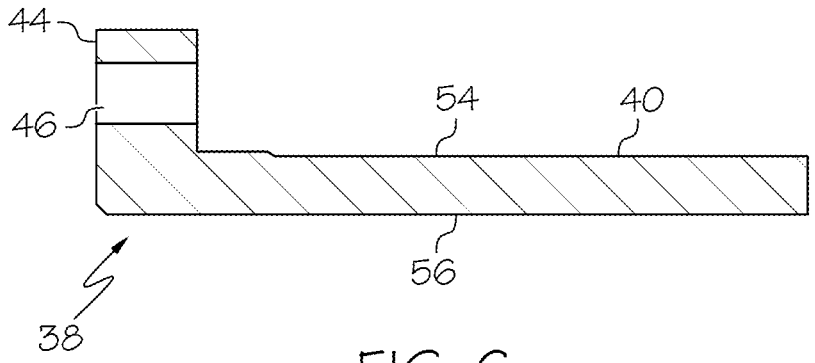
FIG. 6 is a cross-sectional view of the inlet ring adapter taken along line 6-6 in FIG. 5.

Referring to FIGS. 2, 5 and 6, the coupling 24 includes an inlet ring adapter 38 that is affixed to the inlet opening or upstream end 20 of the transition duct 14. In a preferred embodiment, the inlet ring adapter 58 is configured to be detachably mounted to the upstream end 20 of the transition duct 14, and thereby become a structure of the upstream end 20 for cooperating with the spring clip seal 30. The inlet ring adapter 38 has a top-hat configuration comprising a cylindrical sleeve 40 for extending parallel a longitudinal axis 42 (FIG. 3) of the transition duct 42, and a flange portion 44 extending radially outwardly perpendicular to the sleeve 40 and configured for attachment to the upstream end 20 of the transition duct 14.

Figure 4:
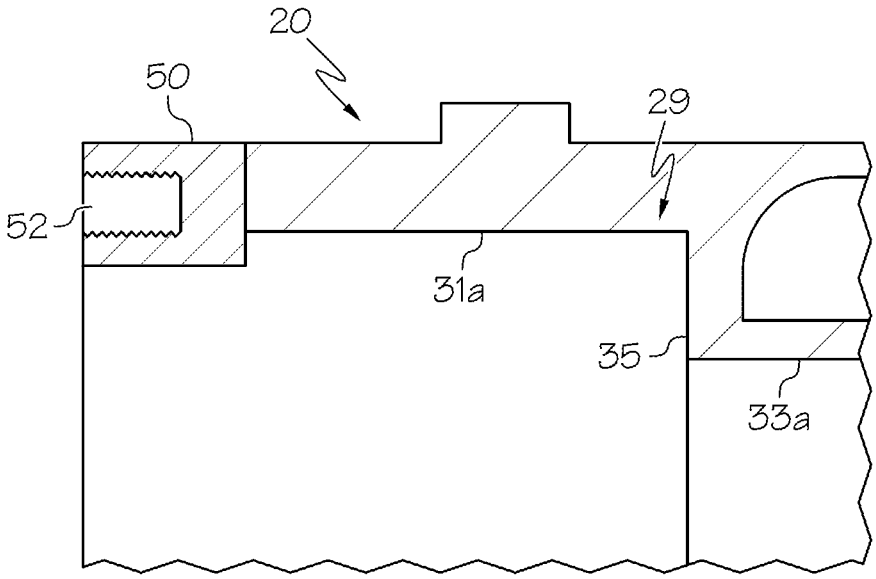
FIG. 4 is an enlarged view of a transition inlet end in accordance with an aspect of the invention.

As seen in FIGS. 5 and 6, the flange portion 44 of the inlet ring adapter 38 is formed with a plurality of apertures 46 for receiving removable fasteners (FIG. 7), such as bolts 48. In accordance with an aspect of the invention, a bolt ring 50 is affixed to the upstream end 20 of the transition duct 14, wherein the bolt ring 50 defines threaded holes 52 (FIG. 4) at the upstream end 20 of the transition duct 14 for receiving the bolts 48 to rigidly affix the inlet ring adapter 38 to the transition duct 14. Further, Nord-Lock® washers 49 (FIG. 7) may be provided to facilitate retention of the bolts 48 in position.

In the configuration illustrated in FIGS. 1-4, the bolt ring 50 may be welded to a forward facing edge of the transition duct 14. It may be understood that the bolt ring 50 is formed with a radial thickness dimension that is greater than the radial thickness dimension of the upstream end 20 of the transition duct 14 so as to provide sufficient material thickness for formation of the threaded holes 52. In particular, the bolt ring 50 provides additional material thickness extending radially inwardly from the first inner surface 31*a* of the upstream end 20.

The present coupling 24 may comprise a retrofit installation on an engine, and it may be necessary to grind down a portion of the forward facing (upstream) edge of the transition duct 14 to accommodate the additional axial dimensions provided by the bolt ring 50 and/or the inlet ring adapter 38. Alternatively, if the transition duct 14 is formed as a new component for installation in the engine, the structure of the bolt ring 50 and associated bolt holes 52 may be formed, such as by casting, integrally with the transition duct 14, as is illustrated by the bolt ring 50 in FIG. 7.

Referring to FIG. 7, the sleeve 40 of the inlet ring adapter 38 is formed with a radial thickness that is less than a radial dimension of the radial step wall 35, from the first inner surface 31*a* to the second inner surface 33*a*. Further, an outwardly facing surface 54 of the inlet ring adapter sleeve 40 is spaced inwardly from the first inner surface 31*a* a radial distance $d_1$, and the distance $d_1$ is approximately equal to or slightly greater than the inward extension of the bolt ring 50 from the first inner surface 31*a*. Also, in the illustrated embodiment, a radial inward surface 56 of the inlet ring adapter sleeve 40 is located at a diameter that is greater than the second diameter 33 defined by the second inner surface 33*a*, and a distal end 41 of the sleeve 40 extends to a location closely adjacent to the radial step wall 35, as denoted by axial distance $d_2$. The distance $d_2$ is preferably sufficient to avoid contact between the distal end 41 of the sleeve 40 and the step wall 35 in view of thermal movement and vibrations occurring during operation of the engine, and is also preferably small to minimize flow of gases into the space between the first inner surface 31*a* and the sleeve 40.

In accordance with an aspect of the invention, the radial inward surface 56 of the inlet ring adapter sleeve 40 forms an engagement surface for contact with the spring clip seal 30 to define the seal at the coupling 24. It may be noted that there is typically relative movement between the spring clip seal 30 and the sleeve 40 as a result of variations in thermal movement between the combustor basket 12 and the transition duct 14, as well as due to relative vibratory movement between the combustor basket 12 and the transition duct 14. Hence, the inward surface 56 of the sleeve 40 may experience wear during continued operation of the engine. In prior or known constructions comprising a seal formed at an interface between a spring clip seal and a transition duct, the spring clip seal would engage and cause wear or deterioration of the interior surface of the transition duct. Such wear typically has required a costly repair operation of the inlet end, i.e., repair of the transition inlet ring, or replacement of the transition duct. Further, such repairs may introduce tolerance variations, leading to non-uniform contact with the spring clip seal with increased stress on the spring clip seal, potentially causing premature failure of the spring clip seal during subsequent operation of the engine.

The present inlet ring adapter 38 provides a detachably replaceable component, i.e., an expendable component, that can be formed with relatively high precision for uniform engagement with the spring clip seal 30, facilitating a longer operating life for the spring clip seal 30. Additionally, prior to installation, the inlet ring adapter 38 can be provided with a wear coating, such as by electroplating or an alternative coating process to provide desired extended wear characteristics for cooperating with the spring clip seal 30.

Additionally, the sleeve 40 of the inlet ring adapter 38 effectively reduces the size of the inlet diameter and of the step from the second inner wall 33*a*, that may effect a reduction in recirculating flow at the end of the combustor basket 12. For example, the reduced step dimension along the step wall 35 may reduce recirculating flow in a space 58 (FIG. 2) between the radial inward surface 56 and the spring clip fingers 34. The reduction in the diameter that can be provided by the inlet ring adapter 38 also permits the transition duct 14 to be used with spring clip ring structures having smaller diameters than an original spring clip structure designed for the transition duct 14. That is, the combustor basket 12 may be retrofit with a new or different spring clip seal 30 that has a different diameter, e.g., a smaller diameter, than the spring clip seal being replaced, and the inlet ring adapter 38 may be used to facilitate matching the inlet diameter of the transition duct 14 to the new spring clip seal 30.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A combustion system for a gas turbine engine, comprising:

a combustor assembly comprising a combustor basket having a liner and a downstream terminal end; a transition duct extending downstream from the combustor basket and having an upstream end located adjacent to the downstream terminal end of the combustor basket;

an inlet ring adapter affixed to the upstream end of the transition duct, the inlet ring adapter extending downstream of the upstream end of the transition duct in overlapping relation to an inner surface of the transition duct;

a spring clip assembly mounted to the downstream terminal end of the combustor basket and resiliently biased into engagement with an inwardly facing surface of the inlet ring adapter forming a coupling between the combustor basket and the transition duct; and wherein the transition duct is a single piece that has a radial step wall at the upstream end to define a first larger diameter adjacent to a cylindrical sleeve of the inlet ring adapter and a second smaller diameter extending in a direction distal from the inlet ring adapter, wherein the radial step wall extends perpendicularly from the inner surface of the transition duct to a second inner surface of the transition duct; and wherein the cylindrical sleeve of the inlet ring adapter extends generally parallel to the transition duct between the liner and the inlet ring adapter, and comprises a flange portion extending perpendicular to the cylindrical sleeve and attached to the upstream end of the transition duct.

2. The system of claim 1, wherein the flange portion is formed with apertures for receiving removable fasteners.

3. The system of claim 2, wherein the upstream end of the transition duct includes threaded holes for receiving fasteners received through the apertures in the flange portion.

4. The system of claim 3, including a bolt ring affixed to the upstream end of the transition duct and including the threaded holes, the bolt ring defining a radial thickness that is greater than a radial thickness of the upstream end of the transition duct.

5. The system of claim 4, wherein the bolt ring is welded to the upstream end of the transition duct.

6. The system of claim 4, wherein the bolt ring is formed integral with the upstream end of the transition duct.

7. The system of claim 1, wherein the inwardly facing surface of the inlet ring adapter defines an inner diameter that is greater than the second smaller diameter of the transition duct.

8. The system of claim 1, wherein the sleeve of the inlet ring adapter includes a distal downstream end that is located adjacent to the radial step of the transition duct to effect a reduction in recirculation flow at the radial step.

9. A combustion system for a gas turbine engine, comprising:

a combustor assembly comprising a combustor basket having a liner and a downstream terminal end;

a transition duct extending downstream from the combustor basket and having an upstream end located adjacent to the downstream terminal end of the combustor basket;

a coupling comprising:

an inlet ring adapter including a cylindrical sleeve extending downstream of the upstream end of the transition duct in overlapping relation to an inner surface of the transition duct; and a spring clip assembly mounted to the downstream terminal end of the combustor basket, the spring clip assembly extending into engagement with and forming a seal on the cylindrical sleeve;

wherein the transition duct is a single piece that has a radial step wall at the upstream end to define a first larger diameter adjacent to the cylindrical sleeve and a second smaller diameter extending in a direction distal from the cylindrical sleeve; wherein the radial step wall extends perpendicularly from the inner surface of the transition duct to a second inner surface of the transition duct; and wherein the cylindrical sleeve of the inlet ring adapter extends generally parallel to the transition duct between the liner and the inlet ring adapter, and comprises a flange portion extending perpendicular to the cylindrical sleeve and attached to the upstream end of the transition duct.

10. The system of claim 9, wherein the cylindrical sleeve is spaced radially inwardly from the inner surface of the transition duct.

11. The system of claim 9, wherein the cylindrical sleeve is mounted on the transition duct with removable fasteners.

12. The system of claim 11, including a flange portion extending radially outwardly from the cylindrical sleeve, and apertures formed through the flange portion for receiving the removable fasteners.

13. The system of claim 12, including a bolt ring welded to the upstream end of the transition duct, and including threaded holes for receiving the removable fasteners.

14. The system of claim 9, wherein at least a portion of the spring clip assembly is resiliently biased into engagement with an inwardly facing surface of the cylindrical sleeve.

15. The system of claim 9, wherein an inwardly facing surface of the cylindrical sleeve defines an inner diameter that is greater than the second smaller diameter of the transition duct.

16. The system of claim 9, wherein the cylindrical sleeve includes a distal downstream end that is located adjacent to the radial step of the transition duct to effect a reduction in recirculation flow at the radial step.

* * * * *